United States Patent [19]

Bobbowski et al.

[11] Patent Number: 5,062,181

[45] Date of Patent: Nov. 5, 1991

[54] CONTINUOUS HINGE WITH IMPROVED BEARING DESIGN

[75] Inventors: Louis G. Bobowski, Berlin; Richard H. Kon, Avon, both of Conn.

[73] Assignee: The Stanley Works, New Britain, Conn.

[21] Appl. No.: 654,735

[22] Filed: Feb. 12, 1991

[51] Int. Cl.[5] ..... E05D 1/00

[52] U.S. Cl. ..... 16/354; 16/273; 16/234

[58] Field of Search ..... 16/234, 273, 354

[56] References Cited

U.S. PATENT DOCUMENTS

| | | |
|---|---|---|
| 83,062 | 10/1868 | Hover . |
| 179,409 | 7/1876 | Hopkins . |
| 293,796 | 2/1884 | Shepard . |
| 340,688 | 4/1886 | Van Slyke . |
| 368,539 | 8/1887 | Ludlow . |
| 498,564 | 5/1893 | Morris . |
| 2,546,590 | 3/1951 | Ferrel . |
| 2,668,320 | 2/1954 | Lustig . |
| 3,092,870 | 6/1963 | Baer . |
| 3,374,499 | 3/1968 | Horstman . |
| 3,402,422 | 9/1968 | Baer . |
| 3,422,487 | 1/1969 | Dickinson et al. . |
| 3,483,588 | 12/1969 | Hover . |
| 3,499,183 | 9/1969 | Parsons . |
| 3,881,221 | 5/1975 | Schmidt . |
| 3,921,225 | 11/1975 | Suska . |
| 3,991,436 | 11/1976 | Nagase . |
| 4,056,985 | 11/1977 | Worrallo . |
| 4,443,911 | 4/1984 | Bannister . |
| 4,444,240 | 4/1984 | Bannister . |
| 4,477,941 | 10/1984 | Gregg . |
| 4,479,753 | 10/1984 | Thorley . |
| 4,606,394 | 8/1986 | Bannister . |
| 4,614,454 | 9/1986 | Kassai . |
| 4,630,332 | 12/1986 | Bisbing . |
| 4,679,277 | 7/1987 | Shibata . |
| 4,761,853 | 8/1988 | Hoffman . |
| 4,765,027 | 8/1988 | Andric . |
| 4,807,330 | 2/1989 | Gomes . |
| 4,907,289 | 3/1990 | Kamimura et al. . |
| 4,976,008 | 12/1990 | Baer . |

*Primary Examiner*—Robert L. Spruill
*Assistant Examiner*—Carmine Cuda

[57] ABSTRACT

An extruded hinge with a multiplicity of bearing assemblies spaced along its length has a pair of abutting hinge leaves with mounting portions and pivot portions with convexly arcuate surfaces extending along their abutting edges and intermeshing gear teeth extending along the length thereof. The pivot portions have channels in their surfaces opposite the arcuate geared surface, and the hinge leaves have pairs of axially offset, opposed cooperating cutouts extending through the pivot portions. These cutouts provide a center portion in which the cutouts are aligned and recesses at the axial ends thereof in opposite hinge leaves. An elongated lateral bearing member has a cavity therewithin which receives the pivot portions, and it has opposed flanges at its free ends, which extend into the channels of the pivot portions to lock the hinge leaves in assembly. In each of the cutouts is a bearing block with a body portion disposed in the center portion of the cutouts and axially projecting portions at each end disposed within the recesses defined by the cutouts. The bearing block has channels along its sides which seat the bearing member flanges. Bearing caps are disposed in the cutouts between the ends of the body portion of the bearing block and the adjacent pivot portions of the leaves, and they are engaged with their respective pivot portions and pivotable therewith.

24 Claims, 5 Drawing Sheets

CONTINUOUS HINGE WITH IMPROVED BEARING DESIGN

BACKGROUND OF THE INVENTION

The present invention relates to hinges and, more particularly, to continuous hinges with bearing elements provided therein.

Continuous hinges of the type utilizing intermeshing gear teeth have received considerable acceptance for a number of applications, particularly for relatively durable and high strength hinged connections, or where some sealing action is desired. Such hinges are illustrated and described in Baer U.S. Pat Nos. 3,092,870 and 3,402,422.

In the latter of these patents, Baer improved the hinge construction by the introduction of synthetic resin thrust bearing elements seated in cutouts along the length of the hinge and to preclude relatively longitudinal movement of the two hinge leaves relative to each other. Although such thrust bearing elements have proven useful, they have exhibited excessive wear largely due to the machined surfaces of the metal hinge elements bearing upon the plastic thrust bearing members.

It is an object of the present invention to provide a novel continuous hinge with an improved bearing design providing relatively long life for the hinge and its bearing components.

It is also an object to provide such a hinge in which the components can be readily and relatively economically fabricated and which may be relatively easily assembled to provide a unitary hinge structure.

Another object is to provide such a hinge which may be inverted for use on either left or right handed doors.

A further object is to provide such a hinge which utilizes a minimum amount of bearing components and reduce the associated number of cutouts in the hinge leaves to reduce stress concentrations for very heavy door applications.

Yet another object is to provide such a hinge with low friction between the hinge components to reduce the opening and closing forces of the door on automatic door operators.

SUMMARY OF THE INVENTION

It has now been found that the foregoing and related objects may be readily attained in an extruded hinge with a multiplicity of bearing assemblies spaced along its length. The hinge has a pair of abutting hinge leaves each having a mounting portion and a pivot portion extending along its abutting edge. The pivot portions have convexly arcuate surfaces with intermeshing gear teeth extending axially along the length thereof, and they also have channels in their opposite surfaces. Spaced along the hinge leaves are a multiplicity of pairs of opposed cooperating cutouts which extend through the pivot portions into the mounting portions, and the cutouts of each pair are axially offset to provide a center portion in which the cutouts are aligned and recesses at the axial ends thereof in opposite hinge leaves.

An elongated lateral bearing member of generally C-shaped cross section provides an axially extending cavity therewithin and opposed flanges at its free ends. The cavity receives the pivot portions of the hinge leaves, and the flanges extend into the channels of the pivot portions to lock the hinge leaves with their pivot portions in intermeshing engagement. The hinge leaves are pivotable relative to each other about their abutting geared surfaces within the cavity of the bearing member.

A bearing block is located in each of the cutouts of the hinge leaves and within the cavity of the bearing member. The block has an axially extending body portion seated in the aligned center portion of the cutouts and of lesser length than the center portion, and the block also has axially projecting portions at each end disposed within the recesses defined by the cutouts. The block also has channels along its sides in which are seated the flanges of the elongated lateral bearing member. Bearing caps are disposed within the cavity and in the cutouts at the ends of the bearing block between the ends of the body portion thereof and the adjacent pivot portions of the leaves. These bearing caps are engaged with one of the opposed pivot portions and are pivotable therewith, and they are dimensioned and configured to provide bearing surface contact with the adjacent surface of the bearing block over an area extending beyond the teeth of the opposite leaf.

In the preferred embodiment, the channels in the hinge leaves provide arcuate surfaces and the flanges of the bearing member have cooperating arcuate surfaces. The channels of the bearing blocks also provide arcuate surfaces which cooperate with the arcuate surfaces of the flanges.

The mounting portions of the hinge leaves have axially extending ribs projecting therefrom in spaced relationship to the pivot portions, and the lateral bearing member seats therebetween. Most usually, the pivot portions of the hinge leaves are of generally C-shaped cross section with the gear teeth formed in the outer surface thereof.

The bearing caps have a recess in one surface in which the pivot portion of the hinge leaf is seated to mount the cap thereon and to preclude relative rotation therebetween. Desirably, the bearing cap is of generally C-shaped configuration with an arcuate side surface for disposition against the side surface of the adjacent bearing block projecting portion. The bearing blocks and bearing caps are fabricated from synthetic resin or smooth wear resistant metals such as sintered stainless steel.

In the preferred embodiment, each bearing assembly along the axial length of the hinge comprises two pairs of cutouts with the offset portions reversed and defining a center section therebetween. The bearing caps are disposed on the pivot portions of the center section, and are of substantially mirror image configuration.

There is also included a member threadably seated in the body portion of at least one of the bearing blocks, and it has one end extending outwardly into abutting engagement with the lateral bearing member to prevent relative axial movement of the lateral bearing member relative to the bearing block. This threadably engaged member is adjustable in the bearing block and has its opposite end portion exposed for adjustment of the length of the outwardly extending portion.

In a preferred assembly, the hinge includes a drip cap secured to the upper end of the elongated lateral bearing member having a top wall which overlies the upper end of the bearing member to seal substantially the entry downwardly into the bearing surfaces to rain and particulate matter. The cap has a generally U-shaped depending wall which snap into the bearing member.

DETAILED DESCRIPTION OF PREFERRED EMBODIMENT OF THE INVENTION

Figure 1:
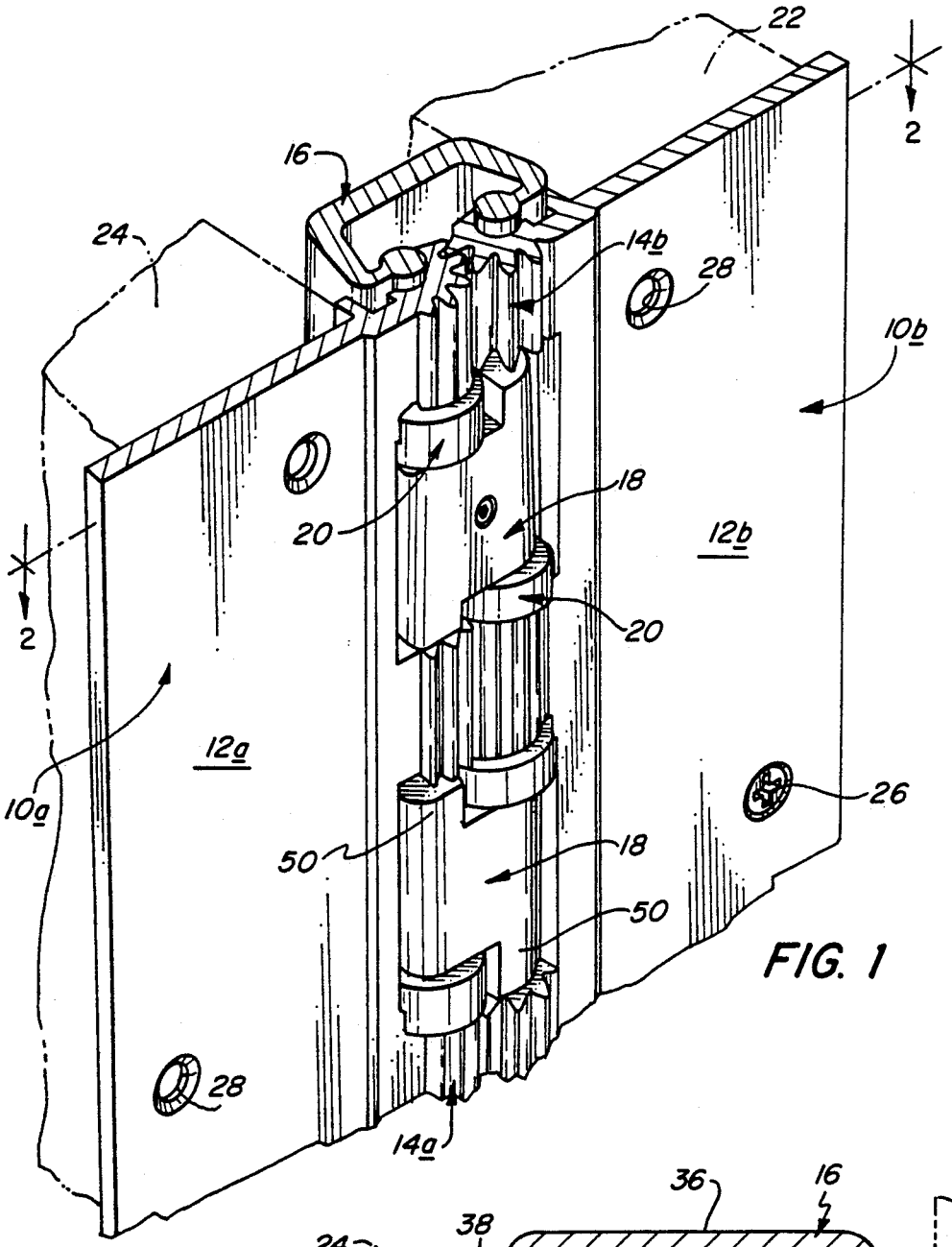
FIG. 1 is a fragmentary perspective view of a hinge embodying the present invention as mounted upon a door frame to provide pivotal support for a door, both shown in phantom line.
Figure 2:
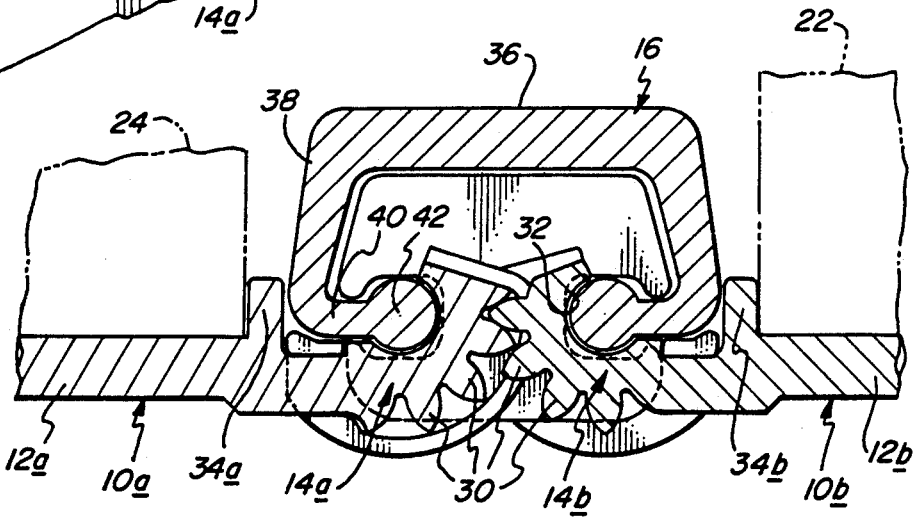
FIG. 2 is a fragmentary sectional view thereof to an enlarged scale and along the line 2—2 of FIG. 1.

Turning first to FIGS. 1 and 2 of the attached drawings, a continuous hinge embodying the present invention is comprised of a pair of elongated extruded hinge leaves generally designated by the numeral 10, each having a planar mounting portion 12 and a pivot portion generally designated by the numeral 14. The pivot portions 14 of the opposed hinge leaves 10 are held together in intermeshing engagement by the lateral bearing member generally designated by the numeral 16, and they have axially offset cutouts 44 along their length as shown in FIG. 3 in which are seated bearing blocks generally designated by the numeral 18 and bearing caps generally designated by the numeral 20.

In FIG. 1, the hinge leaf 10*b* is shown as mounted upon the jamb 22 of a door frame and the hinge leaf 10*a* is shown as mounted upon a door 24. Fasteners 26 extending through apertures 28 in the hinge leaves 10 secure the hinge leaves to the underlying structures.

Figure 3:
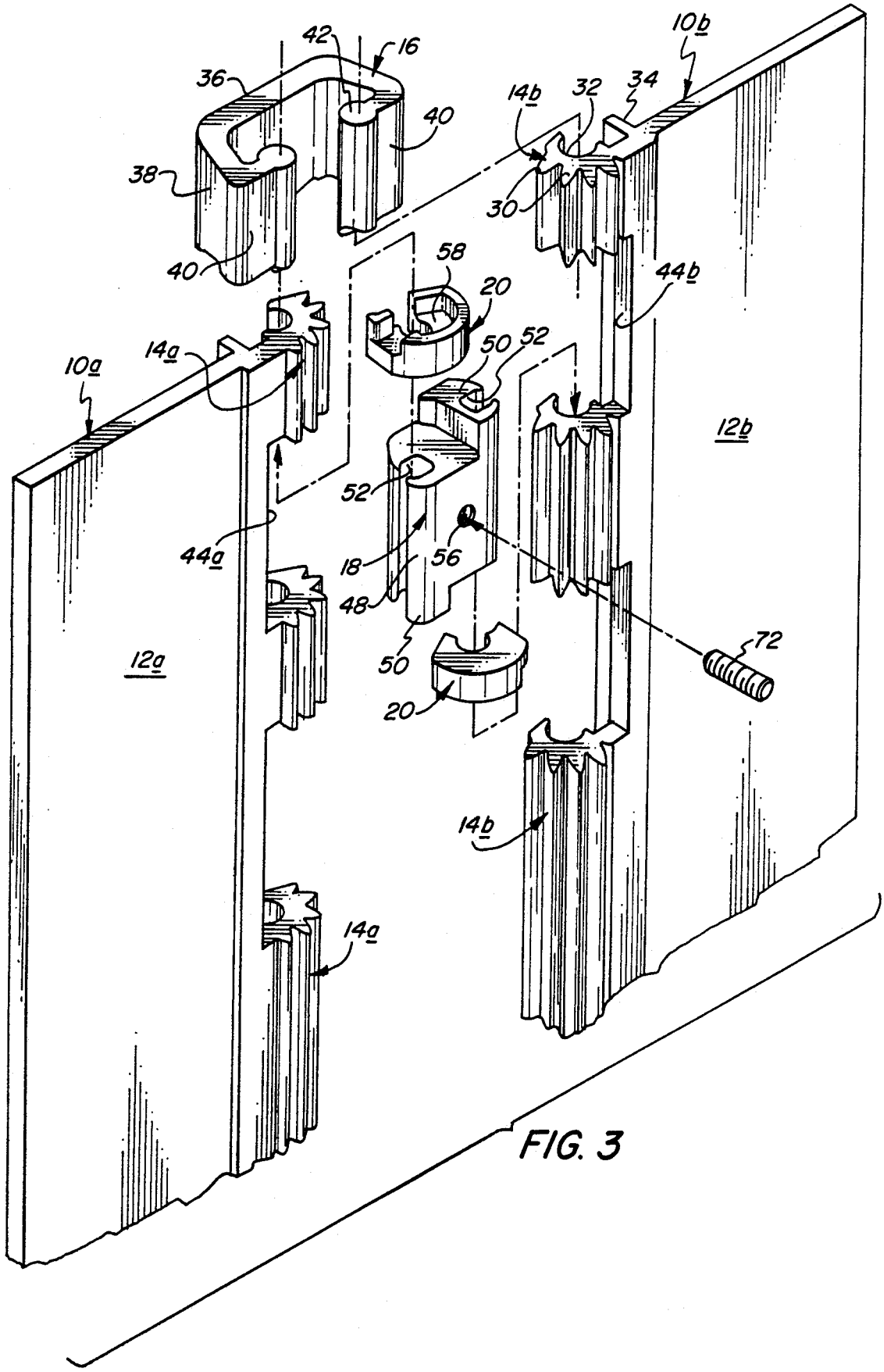
FIG. 3 is a fragmentary exploded view of the hinge with only a portion of the length of the bearing member being illustrated.

As best seen in FIGS. 2 and 3, the pivot portion 14 is of generally arcuate C-shaped configuration with a series of gear teeth 30 extending axially along its convex outer surface, and with an arcuate recess 32 in its concave inner surface. The mounting portion 12 has an upstanding rib 34 extending axially therealong in spaced relationship to the pivot portion 14.

The lateral bearing member 16 is also of generally C-shaped cross section providing a box-like configuration defined by the web 36, the diverging legs 38 and the opposed flanges 40 which terminate in circular bosses 42. As can be seen, the bosses 42 are cooperative configured and dimensioned so as to slide into the arcuate recesses 32 of the hinge leaves 10 and thereby lock the gear teeth 30 of the pivot portions 14 in intermeshing engagement while permitting relative pivotal movement of the hinge leaves 10 thereabout. In FIG. 3, the lateral bearing member 16 has been only fragmentarily illustrated and it should be understood that it extends the full axial length of the hinge to provide both a closure surrounding the pivot portions 14 of the hinge as well as the means for retaining the hinge leaves 10 in assembly.

Figure 4:
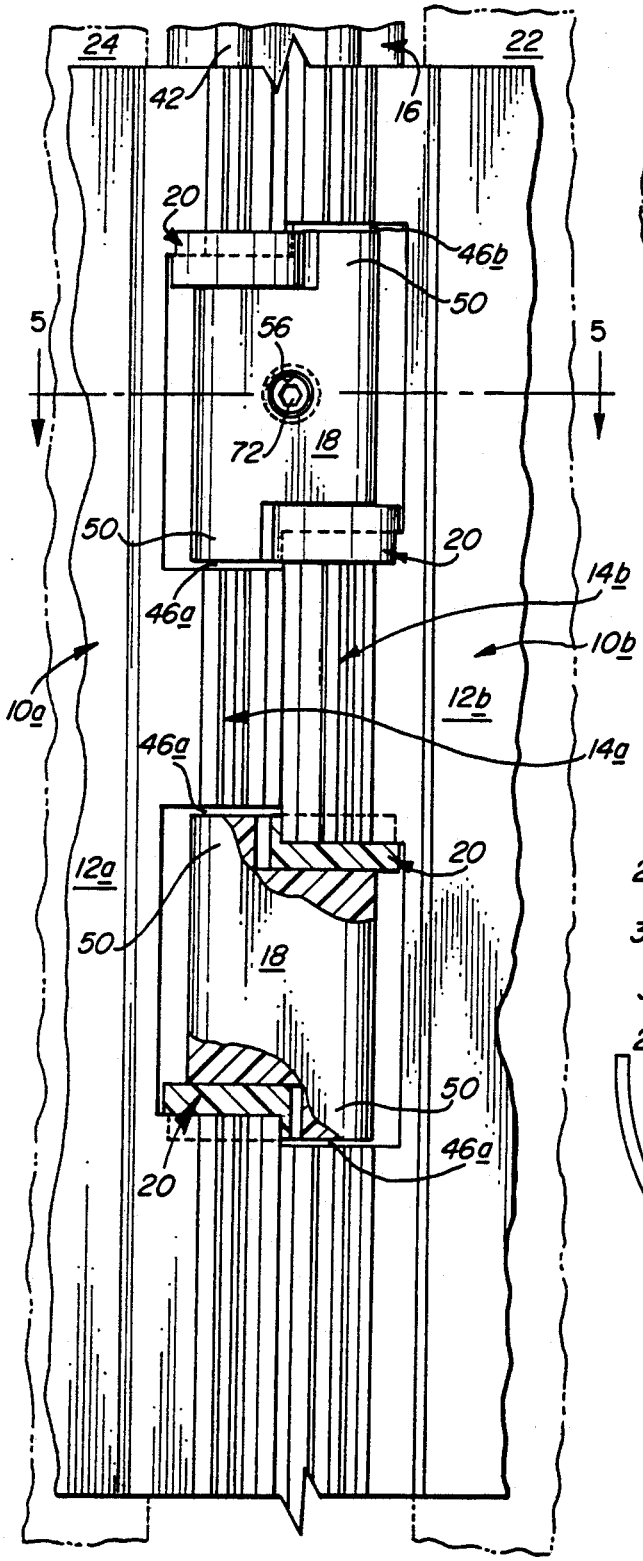
FIG. 4 is a fragmentary front elevational view of the assembly of FIG. 1 to an enlarged scale and with a portion in section to reveal, internal construction.

At two or more spaced points along the length of the hinge leaves 10 are two axially spaced, opposed pairs of axially offset cutouts 44 in the pivot positions 14 and in which are disposed the bearing blocks 18. As seen in FIG. 4, the cutouts 44 are axially offset so as to provide recesses 46 in the opposed leaves 10 which are at the ends of the cutouts 44 and aligned with a solid part of the pivot portion 14 of the opposing leaf 10.

Figure 7:
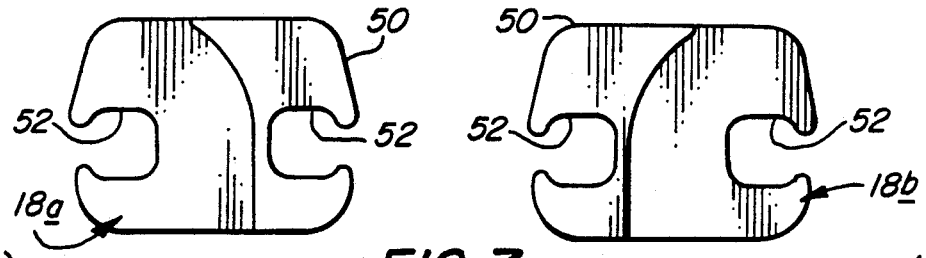
FIG. 7 is a top plan view of the left and right hand bearing blocks used in the hinge of the present invention.
Figure 8:
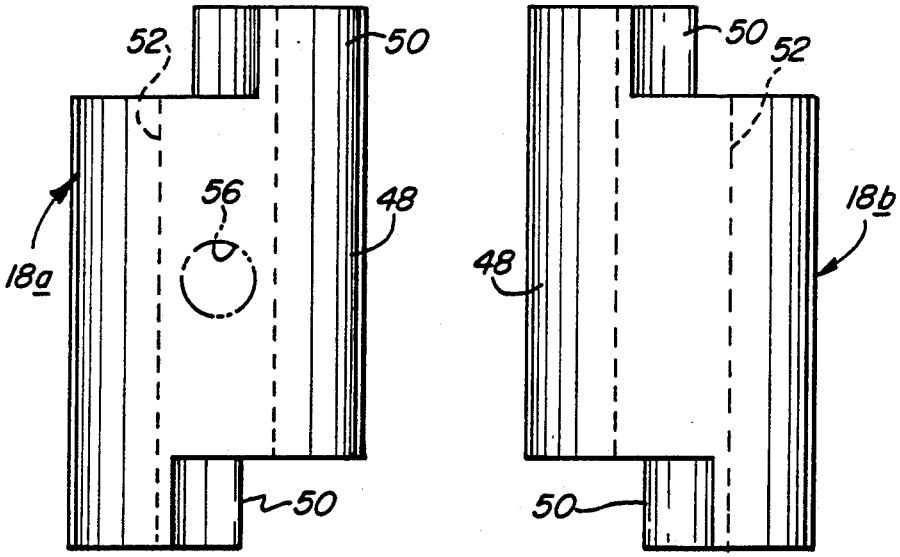
FIG. 8 is a front elevational view of the left and right hand bearing blocks.

Turning now in detail to the bearing block 18, it has an elongated body portion 48 of a width sufficient substantially to bridge the aligned portion of the cutouts 44 and of somewhat lesser axial length than the aligned central portions thereof. The block 18 also has axially projecting portions 50 at each end disposed within the recesses 46 provided by the unaligned portions of the cutouts 44 as shown in FIG. 4. Along both sides of the bearing block 18 are axially extending channels 52 which are dimensioned and configured to slidably receive the circular bosses 42 of the bearing member 16 so as to retain the bearing blocks 18 in assembly therewith. Extending through the body portion 48 is a threaded aperture 56 in which is seated a set screw 72 for a purpose to be described hereinafter. As seen in FIGS. 7 and 8, the blocks 18*a*, 18*b* are mirror images of each other.

Figure 9:
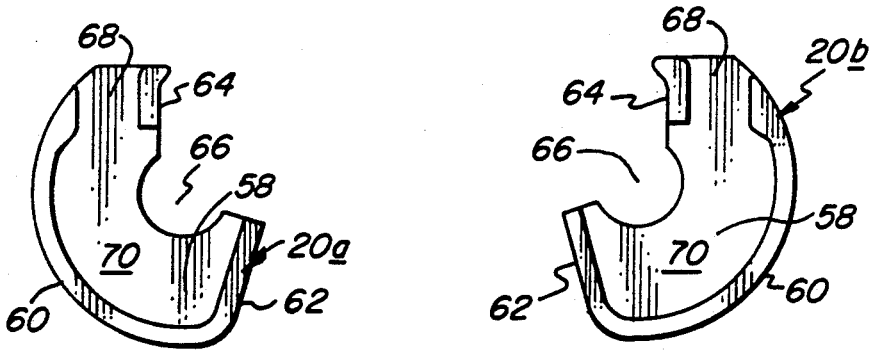
FIG. 9 is a plan view of the left and right hand bearing caps used in the hinge assembly of the present invention, and with the right hand cap inverted from its installed position as seen in FIG. 1.
Figure 10:
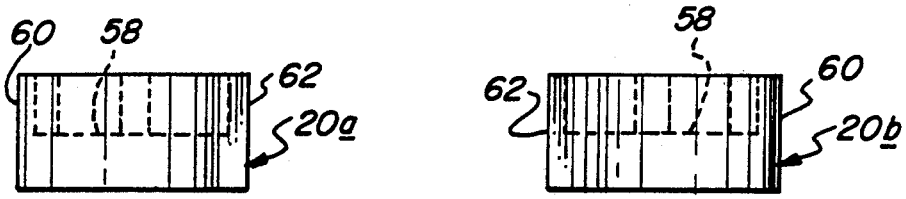
FIG. 10 is a front elevational view of the caps of FIG. 9.

The bearing caps 20 are also of generally C-shaped configuration with a recess 58 in one surface thereof bounded by upstanding arcuate wall 60 which blends into a rectilinear wall 62 at one end, and a short wall 64 which is spaced from its other end. This produces a large entry area 66 and a small channel 68. When pressed against the end of a pivot portion 14, it will seat snugly thereon to prevent relative rotation, and the flange 40 and circular boss 42 readily rotate within the entry provided by the space between the rectilinear wall 62 and short wall 64. As seen in the several figures, the caps are dimensioned and configured so that they extend beyond the roots of the teeth of the opposed pivot portion so as to provide a large bearing area. As best seen in FIGS. 9 and 10, the caps 20 are mirror images of each other.

Figure 5:
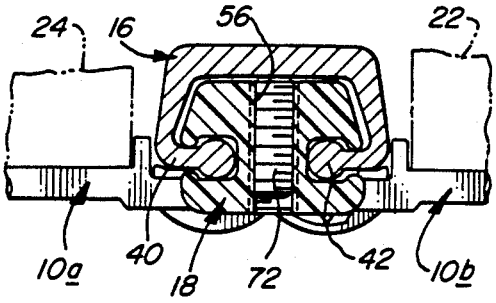
FIG. 5 is a fragmentary sectional view of the assembly along the line 5—5 of FIG. 4 with the door in an open position.
Figure 6:
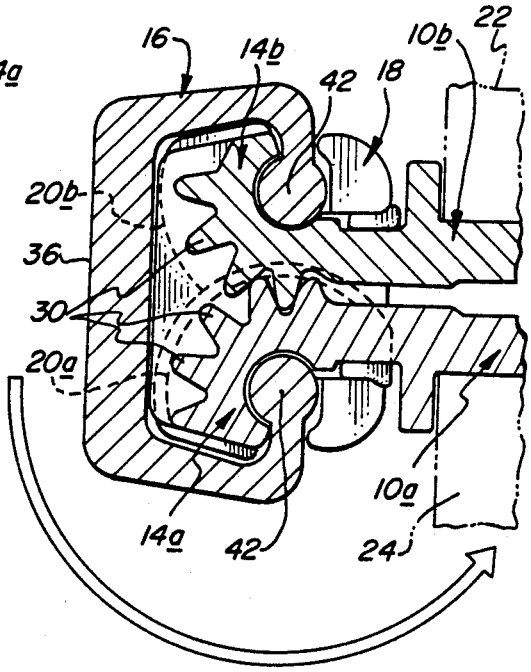
FIG. 6 is a fragmentary sectional view in the same plane with the door pivoted into a fully closed position.

As seen in FIG. 5, a set screw 72 threadably seats in the aperture 56 in the body portion 48 of the bearing block 18 and projects from the opposite surface to bear against the inner surface of the lateral bearing member 16. This provides substantial resistance to relative axial movement of the lateral bearing member 16 and thus serves to retain the several members in assembly.

Figure 11:
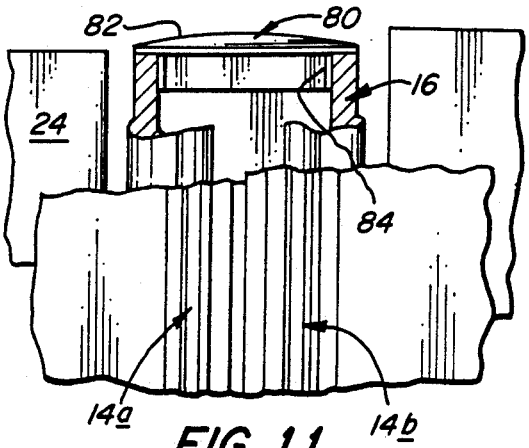
FIG. 11 is a fragmentary front elevational view of the top of the assembly of FIG. 1 showing a drip cap and with a portion broken away to reveal construction.
Figure 13:
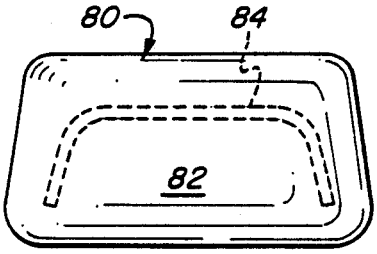
FIG. 13 is a top plan view of the drip cap.
Figure 12:
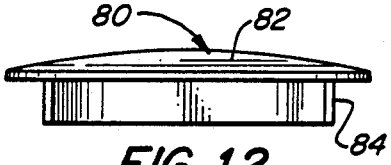
FIG. 12 is a front elevational view of the drip cap.

In FIGS. 11–13, is illustrated a drip cap generally designated by the numeral 80 which is applied over the upper end of the hinge assembly to limit entry of water and particulate matter into the hinge assembly. As can be seen, the cap 80 has a dome-shaped top wall 82 and is dimensioned to overlie the hinge leaves 10*a* and 10*b* and the upper end of the lateral bearing member 16. Its lower surface has a depending generally U-shaped wall 84 which snaps into the upper end of the lateral bearing member 16.

Figure 14:
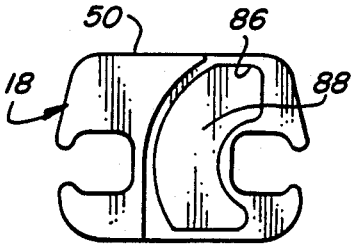
FIG. 14 is a top plan view of a bearing block showing a wear resistant insert seated thereon.

In FIG. 14 is illustrated a composite bearing block 18*a* which has recesses 86 formed therein and into which are placed bearing inserts 88 of a highly wear resistant resin such as the high performance polyimide resin sold by E. I. DuPont under the trademark VESPEL.

In assembling the hinges of the present invention, the two hinge leaves 10*a*, 10*b* are placed together with the gear teeth 30 of their pivot portions 14 intermeshed. The lateral bearing member 16 is introduced at one end of the intermeshed leaves 10 and is slid into the arcuate recesses 32 of the pivot portions 14. As it reaches a cutout 44, bearing caps 20 are assembled onto the pivot portions 14*a*, 14*b* and bearing blocks 18 are inserted with the bearing member 16 being slid into its channels 52. After the members are fully assembled over the full length of the hinge, the set screws 72 are rotated to bind against the lateral bearing member 16 and preclude relative axial movement.

Figure 15:
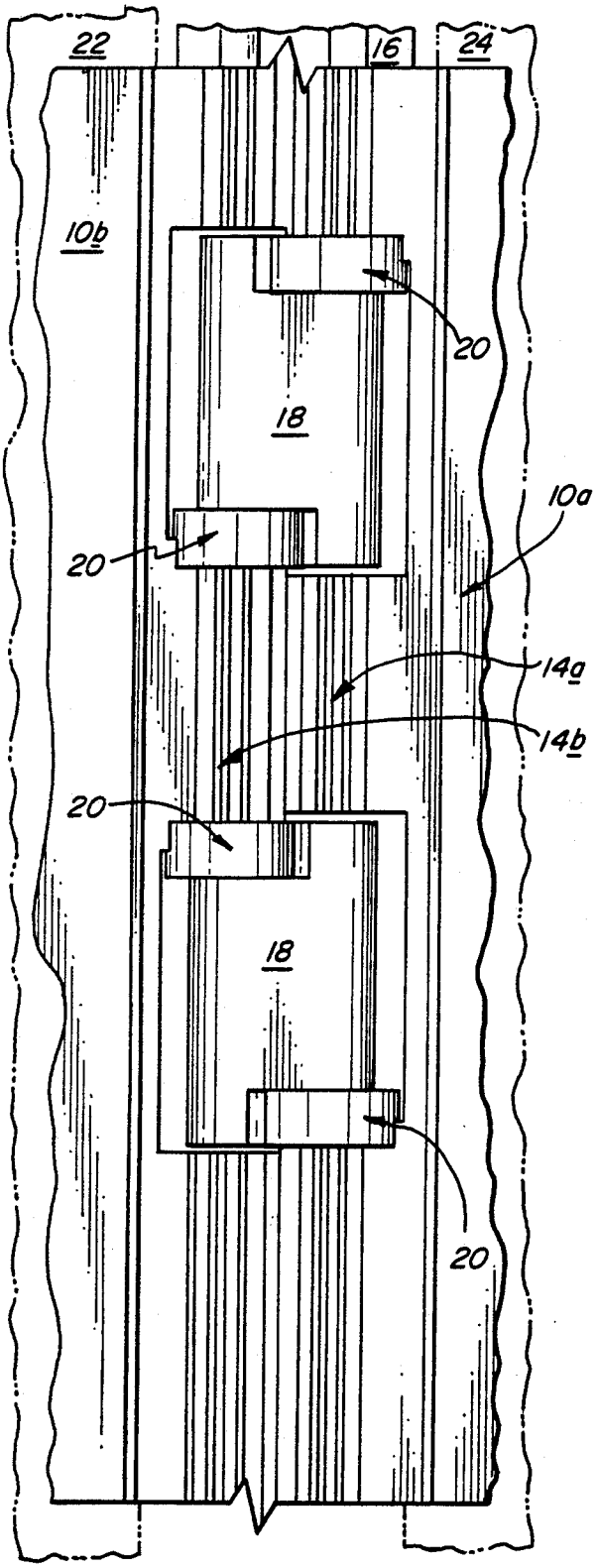
FIG. 15 is a view similar to FIG. 1 but with the hinge side of the door and the leaves of the hinge reversed from the orientation seen in FIG. 1.

In operation of the hinge, it will be appreciated that the bearing surfaces in the thrust or load direction are provided by the bearing caps and the adjacent surfaces of the bearing blocks. Since the bearing caps are fixed on the pivot portions of the hinge, they rotate with their pivot portions, and the bearing surfaces are the flat, molded surfaces of the bearing caps and bearing blocks. To achieve the optimum benefit from this structure, the bearing cap at the upper end of the upper bearing block should be that which is disposed upon the load side, i.e., the door as seen in FIG. 1. If the load is reversed from the position seen in FIG. 1 to that seen in FIG. 15, then the hinge leaves should be reversed in order to maintain the same relationship of the hinge with the pivot portion bearing through the cap upon the bearing block at the uppermost end of the bearing assembly.

As can be seen, the bearing assemblies of the present invention are utilized in axially spaced pairs, i.e., a pair of axially spaced cutouts each containing a bearing block and a pair of end caps as seen in FIG. 1. For most installations, it is sufficient to have tree sets of such bearing assemblies, one pair adjacent the top of the door, one paid at the center of the door, and one pair adjacent the lower end of the door. In longer doors or with heavy loads, it may be desirable to provide intermediate pairs of bearing assemblies and six sets will provide adequate bearing action for heavy doors.

Although the pivot portions may have varying numbers of gear teeth formed thereabout, generally it is desirable that one of the two members have one less tooth than the other so as to enable optimum operation without any tendency for binding. In practice, a combination of the five tooth pivot portion with a four tooth pivot portion has been found quite satisfactory.

The hinge leaves are conveniently formed by extrusion since the profile is uniform over the length thereof, and the same is true with respect to the lateral bearing member. The material utilized for these elements will normally comprise aluminum in order to provide high strength together with light weight and a high degree of resistance to corrosion. However, other metals may also be employed as can be synthetic resins exhibiting a high degree of wear resistance including polyimides, polytetrafluoroethylenes, polyacetals (both homopolymers and copolymers with silicones) and polypropylene.

The cutouts are conveniently formed in the pivot portions by milling, machining, punching or the like. Although precision is required in the placement and dimensioning of the cutouts, deburring is not essential because of the use of the bearing assemblies of the present invention. The apertures for the fasteners to secure the hinge leaves to the door and jamb are conveniently drilled and tapped.

The bearing blocks and end caps are most conveniently formed by sintering metal powders, or injection or compression molding of synthetic resins such as polyimides, polytetrafluoroethylenes, polyacetals (both homopolymers and copolymers with silicones) and polypropylene which exhibit a high degree of wear resistance and lubricity. The bearing blocks may be formed from one resin and inserts of a high performance resin such as the polyimide resin sold by DuPont under the trademark VESPEL may be provided on the upper and lower bearing surfaces. When such inserts are employed, the caps are desirably sintered stainless steel. Following molding of the bearing blocks, they may be bored and tapped as required for the set screws.

Generally, only one bearing block need be provided with a set screw in order to secure the bearing member in its axial position. However, it is preferable to employ one such bearing block at the top portion of the hinge and another bearing block at the lower portion of the hinge.

As can be seen, the rib on the mounting portion of the leaves serves to position the hinge relative to the jamb and to the door since it provides a surface against which these elements abut.

Thus, it can be seen from the foregoing detailed specification and attached drawings that the continuous hinge of the present invention provides a high strength assembly with long lived thrust bearing characteristics. The thrust bearing surfaces comprise controlled planar surfaces bearing upon each other. The elements of the assembly may be relatively easily and economically fabricated and assembled to provide a long lived hinge.

Having thus described the invention, what is claimed is:

1. An extruded hinge with a multiplicity of bearing assemblies spaced along its length an comprising:

(a) a pair of abutting hinge leaves each having a mounting portion and a pivot portion extending along the abutting edge, said pivot portions having convexly arcuate surfaces with intermeshing gear teeth extending along the length thereof and channels in their opposite surfaces, said hinge leaves having a multiplicity of pairs of opposed cooperating cutouts extending through said pivot portions into said mounting portions, the cutouts of each pair being axially offset to provide a center portion in which the cutouts are aligned and recesses at the axial ends thereof in opposite hinge leaves;

(b) an elongated lateral bearing member of generally C-shaped cross section providing an axially extending cavity therewithin and opposed flanges at its free ends, said cavity receiving said pivot portions and said flanges extending into said channels of said pivot portions to lock said hinge leaves with their pivot portions in intermeshing engagement, said hinge leaves being pivotable relative to each other about their abutting geared surfaces within said cavity of said lateral bearing member;

(c) a bearing block in each of said cutouts of said hinge leaves and within said cavity, said block having an axially extending body portion seated in the aligned center portion of said cutouts and of lesser length than said center portion, said block also having axially projecting portions at each end disposed within said recesses defined by said cutouts, said block having channels along its sides in which are seated said flanges of said elongated lateral bearing member; and (d) bearing caps at the ends of said bearing block disposed within said cavity between the ends of the body portion thereof and the adjacent pivot portions of said leaves, said bearing caps being engaged with their respective pivot portions and pivotable therewith, said caps extending beyond the teeth of the pivot portion upon which secured and beyond the teeth of the opposed pivot portion.

2. The hinge in accordance with claim 1 wherein said channels in said hinge leaves provide arcuate surfaces and said flanges of said lateral bearing member have cooperating arcuate surfaces.

3. The hinge in accordance with claim 2 wherein said channels of said bearing blocks provide arcuate surfaces cooperating with said arcuate surfaces of said flanges.

4. The hinge in accordance with claim 1 wherein said mounting portions of said hinge leaves have axially extending ribs projecting therefrom in spaced relationship to said pivot portions, and between which said bearing member is seated.

5. The hinge in accordance with claim 1 wherein said pivot portions of said hinge leaves are of generally C-shaped cross section with said gear teeth being formed in the outer surface.

6. The hinge in accordance with claim 1 wherein said bearing caps have a recess in one surface in which the pivot portion is seated to mount said cap thereon and preclude relative rotation therebetween.

7. The hinge in accordance with claim 6 wherein said bearing cap is of generally C-shaped configuration with an arcuate side surface for disposition against the side surface of the adjacent bearing block projecting portion.

8. The hinge in accordance with claim 1 wherein said bearing blocks and bearing caps are fabricated from synthetic resin.

9. The hinge in accordance with claim 1 wherein each bearing assembly along the axial length of said hinge comprises two pairs of cutouts with the offset portions reversed and defining a center section therebetween, said bearing caps being disposed on the pivot portions of said center section.

10. The hinge in accordance with claim 9 wherein said bearing blocks and bearing caps of each pair are of substantially mirror image configuration.

11. The hinge in accordance with claim 1 wherein there are included a member threadably seated in the body portion of at least one of said bearing blocks and having one end extending outwardly into abutting engagement with said bearing member to prevent relative axial movement of said bearing member with respect to said bearing block.

12. The hinge in accordance with claim 11 wherein said threadably engaged member is adjustable in said bearing block and has its opposite end portion exposed for adjustment of the length of said outwardly extending portion.

13. The hinge in accordance with claim 1 wherein a drip cap is secured on the upper end of said elongated lateral bearing member and has an upper wall overlying the upper end of said lateral bearing member.

14. The hinge in accordance with claim 13 wherein said drip cap has a depending generally U-shaped wall which snaps into the upper end of said lateral bearing member.

15. An extruded hinge with a multiplicity of bearing assemblies spaced along its length and comprising:

(a) a pair of abutting hinge leaves each having a mounting portion and a pivot portion extending along the abutting edge, said pivot portions having convexly arcuate surfaces with intermeshing gear teeth extending along the length thereof and channels in their opposite surfaces, said pivot portions of said hinge leaves being of generally C-shaped cross section with said gear teeth being formed in the outer surface thereof, said hinge leaves having a multiplicity of pairs of opposed cooperating cutouts extending through said pivot portions into said mounting portions, the cutouts of each pair being axially offset to provide a center portion in which the cutouts are aligned and recesses at the axial ends thereof in opposite hinge leaves;

(b) an elongated lateral bearing member of generally C-shaped cross section providing an axially extending cavity therewithin and opposed flanges at its free ends, said cavity receiving said pivot portions and said flanges extending into said channels of said pivot portions to lock said hinge leaves with their pivot portions in intermeshing engagement, said channels in said hinge leaves providing arcuate surfaces and said flanges of said bearing member having cooperating arcuate surfaces, said hinge leaves being pivotable relative to each other about their abutting geared surfaces within said cavity of said lateral bearing member;

(c) a bearing block in each of said cutouts of said hinge leaves and within said cavity, said block having an axially extending body portion seated in the aligned center portion of said cutouts and of lesser length than said center portion, said block also having axially projecting portions at each end disposed within said recesses defined by said cutouts, said block having channels along its sides in which are seated said flanges of said elongated lateral bearing member, said channels of said bearing blocks providing arcuate surfaces cooperating with said arcuate surfaces of said flanges; and (d) bearing caps at the ends of said bearing block disposed within said cavity between the ends of the body portion thereof and the adjacent pivot portions of said leaves, said bearing caps being engaged with their respective pivot portions and pivotable therewith, said caps extending beyond the teeth of the pivot portion upon which secured and beyond the teeth of the opposed pivot portion, each bearing assembly along the axial length of said hinge comprising two pairs of cutouts with the offset portions reversed and defining a center section therebetween, said bearing caps being disposed on the pivot portions of said center section.

16. The hinge in accordance with claim 15 wherein said mounting portions of said hinge leaves have axially extending ribs projecting therefrom in spaced relationship to said pivot portions, and between which said bearing member is seated.

17. The hinge in accordance with claim 15 wherein said bearing blocks and bearing caps of each pair are of substantially mirror image configuration.

18. The hinge in accordance with claim 15 wherein said bearing caps have a recess in one surface in which the pivot portion is seated to mount said cap thereon and preclude relative rotation therebetween.

19. The hinge in accordance with claim 18 wherein said bearing cap is of generally C-shaped configuration with an arcuate side surface for disposition against the side surface of the adjacent bearing block projecting portion.

20. The hinge in accordance with claim 15 wherein said bearing blocks and bearing caps are fabricated from synthetic resin.

21. The hinge in accordance with claim 15 wherein there are included a member threadably seated in the body portion of at least one of said bearing blocks and having one end extending outwardly into abutting engagement with said bearing member to prevent relative axial movement of said bearing member with respect to said bearing blocks.

22. The hinge in accordance with claim 15 wherein said threadably engaged member is adjustable in said bearing block and has its opposite end portion exposed for adjustment of the length of said outwardly extending portion.

23. The hinge in accordance with claim 15 wherein a drip cap is secured on the upper end of said elongated lateral bearing member and has an upper wall overlying the upper end of said lateral bearing member.

24. The hinge in accordance with claim 23 wherein said drip cap has a depending generally U-shaped wall which snaps into the upper end of said lateral bearing member.

* * * * *